US010359226B2

(12) United States Patent
Giacomini et al.

(10) Patent No.: US 10,359,226 B2
(45) Date of Patent: Jul. 23, 2019

(54) PACKAGING SYSTEM FOR DELIVERING APPLIANCE HANDLES WITHIN AN INTERIOR OF THE APPLIANCE AND METHOD THEREFOR

(71) Applicant: Whirlpool Corporation, Benton Harbor, MI (US)

(72) Inventors: Neomar Giacomini, St. Joseph, MI (US); Ishan Khekale, St. Joseph, MI (US); Axel Julio Ramm, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 745 days.

(21) Appl. No.: 14/938,097

(22) Filed: Nov. 11, 2015

(65) Prior Publication Data

US 2017/0131020 A1 May 11, 2017

(51) Int. Cl.
*B65B 5/06* (2006.01)
*F25D 23/02* (2006.01)

(52) U.S. Cl.
CPC ..... *F25D 23/028* (2013.01); *B65B 5/06* (2013.01); *F25D 2400/32* (2013.01)

(58) Field of Classification Search
CPC ..... B65B 5/06
USPC ..... 53/443
See application file for complete search history.

(56) References Cited

U.S. PATENT DOCUMENTS

| | | | |
|---|---|---|---|
| 4,848,581 | A | 7/1989 | Besore et al. |
| 2013/0313958 | A1 | 11/2013 | Moon et al. |

FOREIGN PATENT DOCUMENTS

| | | |
|---|---|---|
| CN | 203078897 | 7/2013 |
| KR | 2003065974 | 8/2003 |
| WO | 2009121844 | 10/2009 |

*Primary Examiner* — Lori L Baker
(74) *Attorney, Agent, or Firm* — Price Heneveld LLP

(57) ABSTRACT

A method for packaging a handle set including providing a refrigerator having a cabinet defining an opening to access an interior; and providing doors defining an aperture for accessing the interior, the aperture width being less than the opening width. A handle set for installation onto the doors. A substrate panel having a panel width that is between the aperture width and the opening width, and to which the handle set to define a handle set package. Inserting the leading edge of the substrate panel through the aperture and the opening and rotating the handle set package through the aperture and the opening such that the trailing edge moves through the opening and into the interior, wherein an installation cutout of the substrate panel provides the handle set package with clearance to be rotated, and wherein the perimeter edge of the handle set substrate panel remains substantially level.

7 Claims, 9 Drawing Sheets

PACKAGING SYSTEM FOR DELIVERING APPLIANCE HANDLES WITHIN AN INTERIOR OF THE APPLIANCE AND METHOD THEREFOR

FIELD OF THE INVENTION

The present disclosure generally relates to an appliance handle delivery system for securing handles within the interior of the appliance during delivery, and more specifically, a substrate panel that receives and secures the appliance handles for secure delivery within the appliance.

BRIEF SUMMARY OF THE INVENTION

In at least one aspect, a method for packaging a refrigerator handle set within a refrigerator includes providing a refrigerator having a cabinet including an interior liner that defines an interior volume and an opening through which the interior volume is accessible. The opening has an opening width. The method also includes providing first and second refrigerator doors attached to the cabinet and operable between a closed position wherein the first and second doors at least partially cover the opening, and an open position defined by the first and second doors and the interior liner cooperating to define an aperture through which the interior volume is accessible, and wherein a width of the aperture is less than the opening width. As part of the method, a handle set is provided that is configured for installation onto at least the first and second doors. A handle set substrate panel is provided that has an upper surface and a perimeter edge, the perimeter edge including a leading edge, a trailing edge and at least one installation cutout that extends between the leading edge and the trailing edge. The substrate panel includes a panel width that is larger than the width of the aperture and less than the opening width. The handle set is attached to the upper surface of the handle set substrate panel to define a handle set package. According to the method, the handle set package is inserted into the interior volume by inserting the leading edge of the substrate panel through the aperture and the opening. The handle set package is rotated through the aperture and the opening such that the trailing edge moves through the opening and into the interior volume, wherein the installation cutout provides the handle set package with clearance to be rotated through the opening and the aperture, and wherein the perimeter edge of the handle set substrate panel remains substantially level with respect to the width of the aperture and the opening width as the handle set package is rotated into the interior volume.

In at least another aspect, a method for securing a handle set for transport within a corresponding refrigerator includes providing a handle set configured for later installation onto doors of an appliance, and providing a handle set substrate panel having an upper surface, a panel width and a beveled portion. The panel includes a panel width that is wider than a width of an aperture through which an interior volume of the appliance is accessible when the doors are in an open position. The method also includes attaching the handle set to the upper surface of the handle set substrate panel to define a handle set package. The handle set package is rotated through the aperture while maintaining the handle set package in a substantially horizontal position such that the beveled portion provides clearance for the panel width to pass through the aperture and moving the doors to a closed positon, wherein at least one of the doors includes an interior surface that engages the package and secures the package within the interior volume when the at least one of the doors is closed.

In at least another aspect, a method for securing a handle set for transport within a corresponding appliance includes providing a handle set configured to be ultimately installed on a plurality of doors of an appliance, providing a handle set substrate panel, the handle set substrate panel including a leading portion, a beveled portion, a securing portion and an upper surface. According to the method, the handle set is installed on the upper surface of the handle set substrate panel. The leading portion is inserted into an appliance through an aperture, wherein the aperture includes a width that is smaller than a panel width of the handle set substrate panel. The method includes rotating the beveled portion and the securing portion through the aperture, wherein the inserting and rotating steps are capable of being performed with the upper surface of the substrate panel being perpendicular to the aperture, and wherein the beveled portion provides an installation cutout that provides clearance for the substrate panel to be installed through the aperture. The method also includes positioning the substrate panel on an internal horizontal surface of the appliance, wherein the substrate panel is positioned entirely within an interior volume of the appliance.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
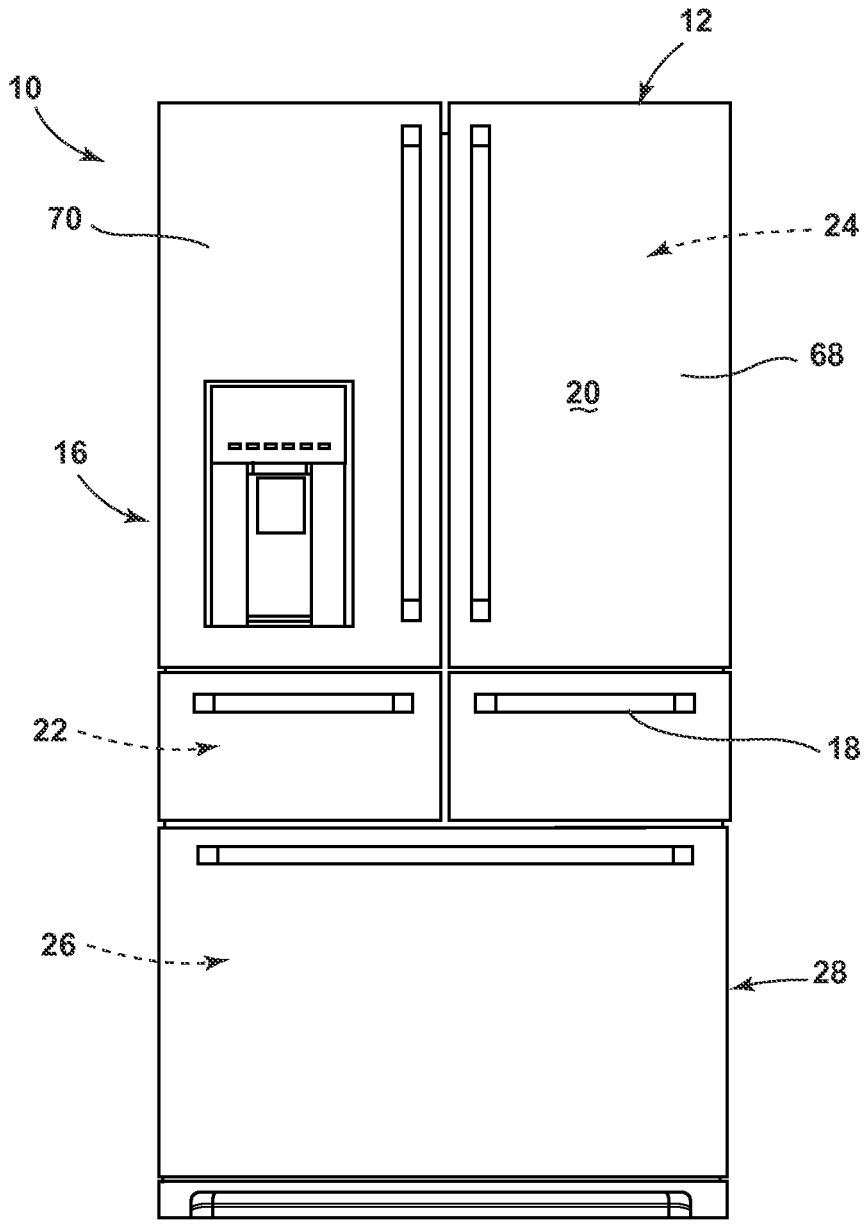
FIG. 1 is a front elevational view of a refrigerating appliance with the appliance handles installed thereon and the appliance doors in the closed position.
Figure 2:
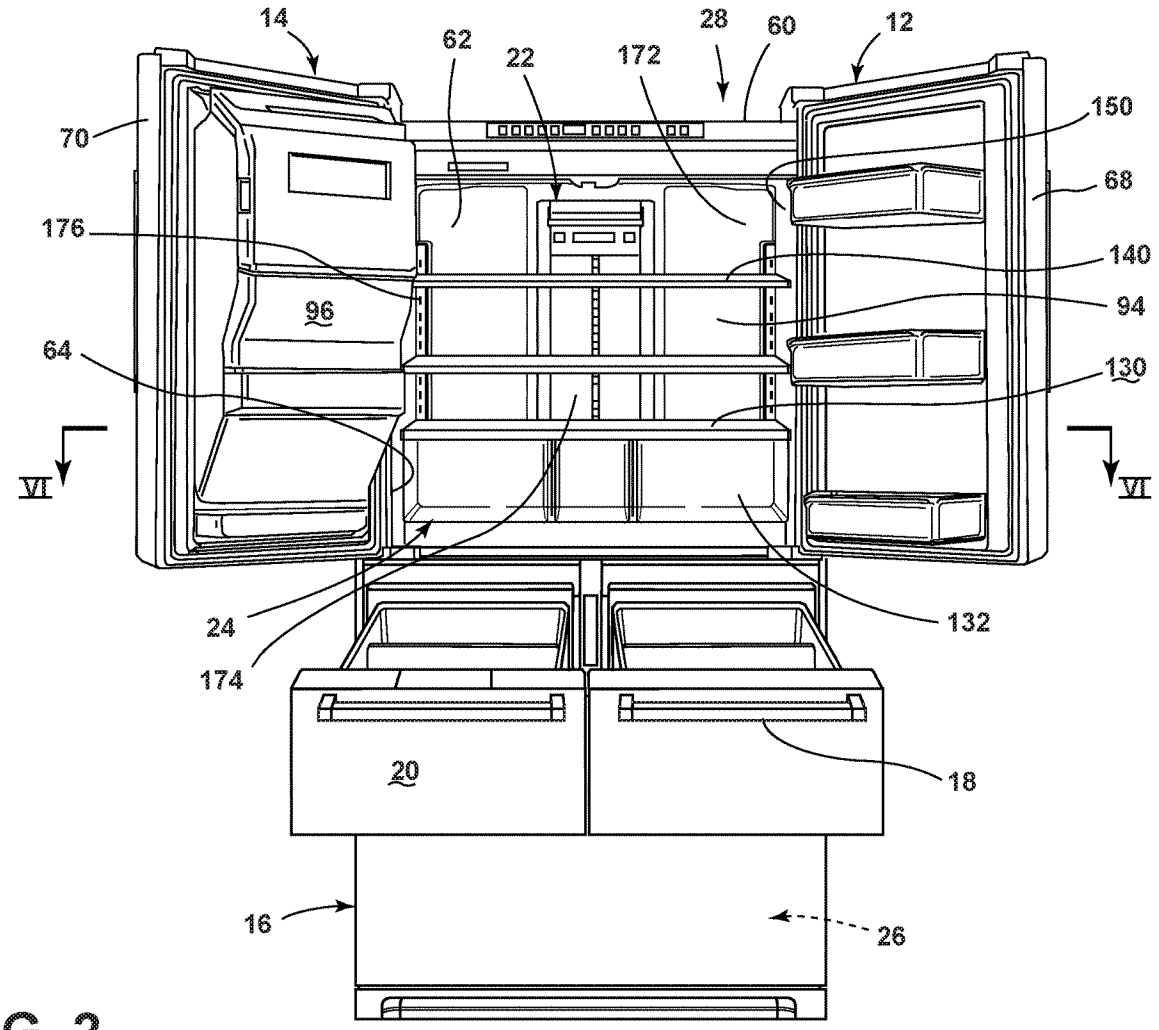
FIG. 2 is the appliance of FIG. 1 with the doors in the open position and showing the crisper compartment contained within the interior volume of the refrigerating appliance.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

Referring to the embodiment illustrated in FIGS. 1-8, an appliance, such as a refrigerating appliance 28, can include one or more doors 12 that are generally operable between open and closed positions 14, 16. In order to allow the user to operate these doors 12, each door can include a handle 18, such as a bar, lever, knob, or other similar grasping feature that the user can engage in order to operate the door between open and closed positions 14, 16. In various appliances, these handles 18 extend outward from an outward surface 20 of the appliance 10 and add to the overall dimension of the appliance 10 for purposes of shipping. Accordingly, when the appliance 10 having handles 18 is being shipped, the handles 18 are typically removed and stored in a location proximate the appliance 10 for shipping from an assembly factory to another location for subsequent delivery or ultimate sale. At some point thereafter, the handles 18 can be removed from the shipping location and installed on the appliance 10 for display, use, or other similar purpose where the handles 18 can be used to operate the doors 12 between the open and closed positions 14, 16. Due to the large open space defined by the interior volume 22 of a typical appliance 10, the handles 18 are often stored inside a refrigerator compartment 24 or a freezer compartment 26, in the case of a refrigerating appliance 28.

Referring again to FIGS. 1-8, according to the various embodiments, the handle set 40 for the appliance 10, which can include all of the removable handles 18 and on the outward surface 20 and/or at least a portion of the handles 18 within the interior volume 22, can be removed from the doors 12 and other portions of the appliance 10 and installed onto a handle set substrate panel 42 and secured thereto. In this manner, the handle set 40 can be packaged for installation within the interior volume 22 of the appliance 10 for storage and/or delivery to a separate location. Once the handle set 40 is disposed on the handle set substrate panel 42, the handle set substrate panel 42 can be disposed within the interior volume 22 of the appliance 10 where the handle set 40 and the handle set substrate panel 42 define a handle set package 44 that can be used to substantially secure the handle set 40 within the interior volume 22 of the appliance 10.

Referring again to FIGS. 1-4, the process of installing the handles 18 within the interior volume 22 of the appliance 10 for delivery includes providing a refrigerator or other appliance 10 having a cabinet 60 that includes an interior liner 62 defining the interior volume 22. The interior liner 62 also defines an opening 64 of the cabinet 60 through which the interior volume 22 is accessible. The opening 64 defined by the interior liner 62 includes an opening width 66. First and second refrigerator doors 68, 70 are also provided and are attached to the cabinet 60 in predetermined locations. Each of the first and second refrigerator doors 68, 70 are operable between open and closed positions 14, 16, where the first and second refrigerator doors 68, 70 at least partially cover the opening 64 when the doors 12 are placed in the closed position 16. In an open position 14, the first and second refrigerator doors 68, 70 and the interior liner 62 cooperate to define an aperture 72 through which the interior volume 22 can be accessible. According to the various embodiments, the width 74 of the aperture 72 is less than the opening width 66. Accordingly, an item configured to be as wide as the opening 64 cannot be installed into the interior volume 22 through the opening 64 without being tilted, folded, bent, angled or otherwise manipulated in some fashion to clear the narrower width 74 of the aperture 72 for ultimate installation within the interior volume 22 of the appliance 10.

According to the various embodiments, the appliance 10 can include the first and second refrigerator doors 68, 70 as well as additional doors 12 that can take the form of rotatable doors, sliding drawers, sliding panels and other similar operable door panels for accessing various internal compartments of the appliance 10.

Referring again to FIGS. 1-5, as discussed above, each of the doors 12 of the appliance 10 can include a dedicated handle 18, where all of the handles 18 collectively define a handle set 40 that is configured for ultimate installation onto at least the first and second refrigerator doors 68, 70. Where additional doors 12 are included within the appliance 10, it is contemplated that other doors 12 in addition to the first and second refrigerator doors 68, 70 may include a dedicated handle 18 that is part of the handle set 40 for the appliance 10. According to the various embodiments, it is contemplated that the handles 18 can take any one of the various forms, where such forms can include, but are not limited to, arcuate shapes, linear shapes, rectilinear shapes, and other similar handle shapes. Additionally, the cross-sectional shape of each of the handles 18 can also vary depending upon the design of the appliance 10. According to various embodiments, the cross-sectional shape of each of the handles 18 can include various shapes that include, but are not limited to, cylindrical, oblong, rectilinear, irregular, polygonal, combinations thereof, and other similar cross-sectional shapes.

Referring again to FIGS. 3-8, in order to position the handle set 40 for installation within the interior volume 22 of the appliance 10, the handle set substrate panel 42 can be provided. The substrate panel 42 can include an upper surface 80 and a perimeter edge 82. The perimeter edge 82 of the substrate panel 42 can include a leading edge 84, a trailing edge 86, and at least one installation cutout 88, in the form of a bevel, chamfer, curved portion, combinations thereof, or other contour that can be linear, arcuate or irregular and is generally non-orthogonal with regard to the leading and trailing edges 84, 86. According to various embodiments, the installation cutout 88 can extend between the leading edge 84 and the trailing edge 86. The substrate panel 42 also includes a panel width 90 and a panel depth 92, wherein the panel width 90 is substantially equal to the opening width 66, being substantially similar to that of the interior volume 22 of the appliance 10. The panel depth 92 is generally similar to the depth of the interior volume 22 of the appliance 10 extending between a back wall 94 of the interior liner 62 and an interior surface 96 of one or more of the doors 12 when in the closed position 16. Accordingly, when the first and second refrigerator doors 68, 70 are in the closed position 16, a horizontal plane defined within the interior volume 22 substantially defines the shape of at least a portion of the substrate panel 42 including the leading edge 84, trailing edge 86, and, in various embodiments, a back edge 98 of the perimeter edge 82 and a side edge 100 of the substrate panel 42 extending between the trailing edge 86 and the back edge 98. As discussed above, the installation cutout 88 defines a bevel, chamfer, or other non-orthogonal line extending substantially between the leading edge 84 and the trailing edge 86 of the substrate panel 42, where the installation cutout 88 defines a portion of the horizontal plane cut through the interior volume 22 not occupied by the substrate panel 42.

According to various embodiments, it is contemplated that the substrate panel 42 can include a single installation cutout 88 or, alternatively, can include two or more separate installation cutouts 88 defined within various portions of the perimeter edge 82 of the substrate panel 42. The design of the substrate panel 42 in terms of the shape of the perimeter edge 82 and the upper surface 80 of the substrate panel 42 can be determined by various factors that include, but are not limited to, the size of the appliance 10, the number of handles 18 for the appliance 10, the size of the handles 18 for the appliance 10, the shape of the handles 18 for the appliance 10, as well as other various factors that bear on the size and shape of the handle set 40 and the substrate panel 42. Additional details of the substrate panel 42 and the installation cutout 88 of the substrate panel 42 will be described more fully below.

Referring again to FIGS. 3-5, once the handle set substrate panel 42 is provided, the handle set 40 for the appliance 10 is attached to the upper surface 80 of the handle set substrate panel 42 to define the handle set package 44. It is contemplated that the handle set package 44 defines a substantially unitary piece such that when the handle set package 44 is moved from one location to another, or otherwise manipulated by an individual or piece of machinery, the handle set 40 is substantially free of movement relative to the handle set substrate panel 42.

Figure 3:
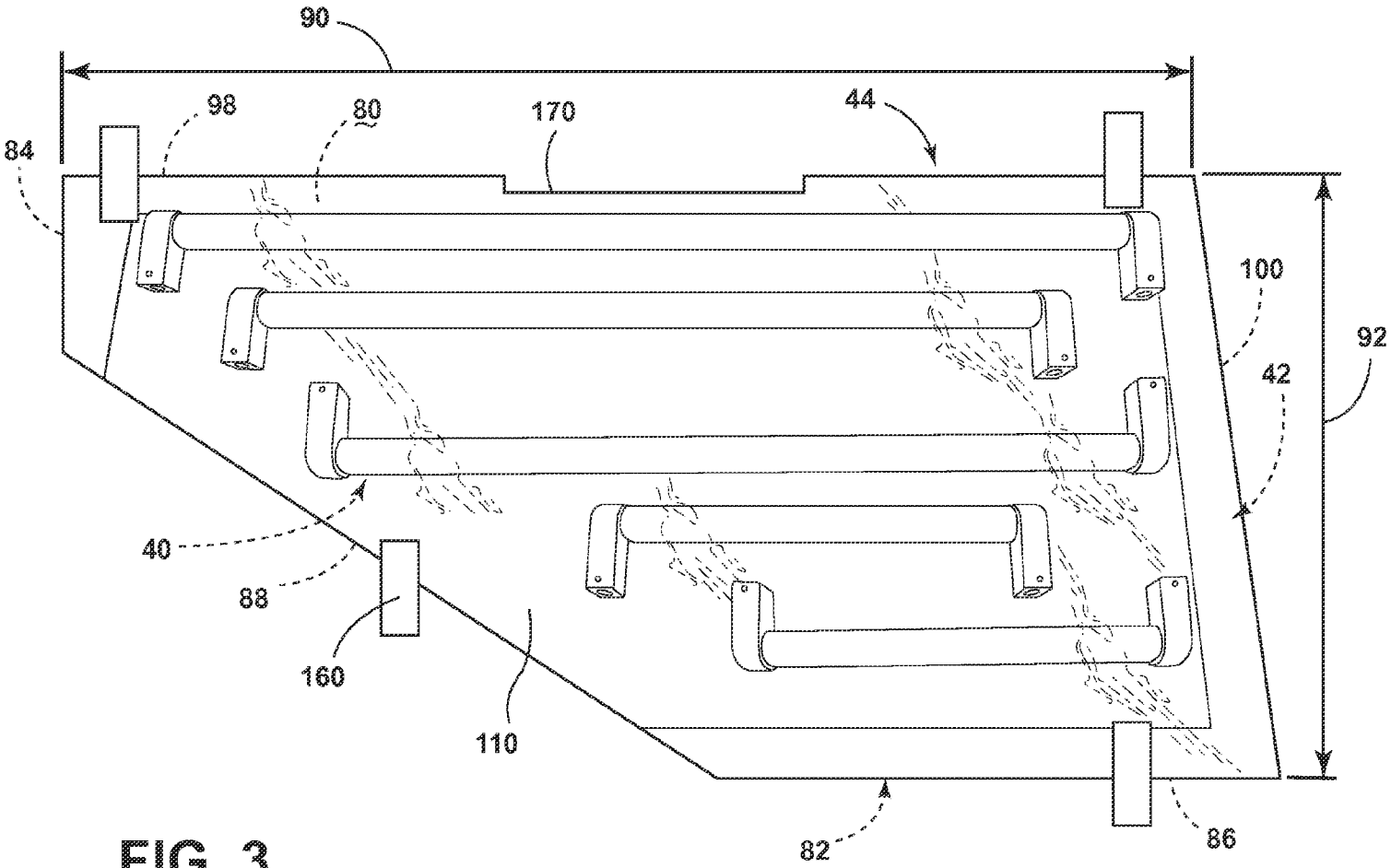
FIG. 3 is a top perspective view of an embodiment of the handle set package prepared for being disposed within the interior of the appliance with the handle set disposed on the handle set substrate panel and secured thereto by a film member.
Figure 4:
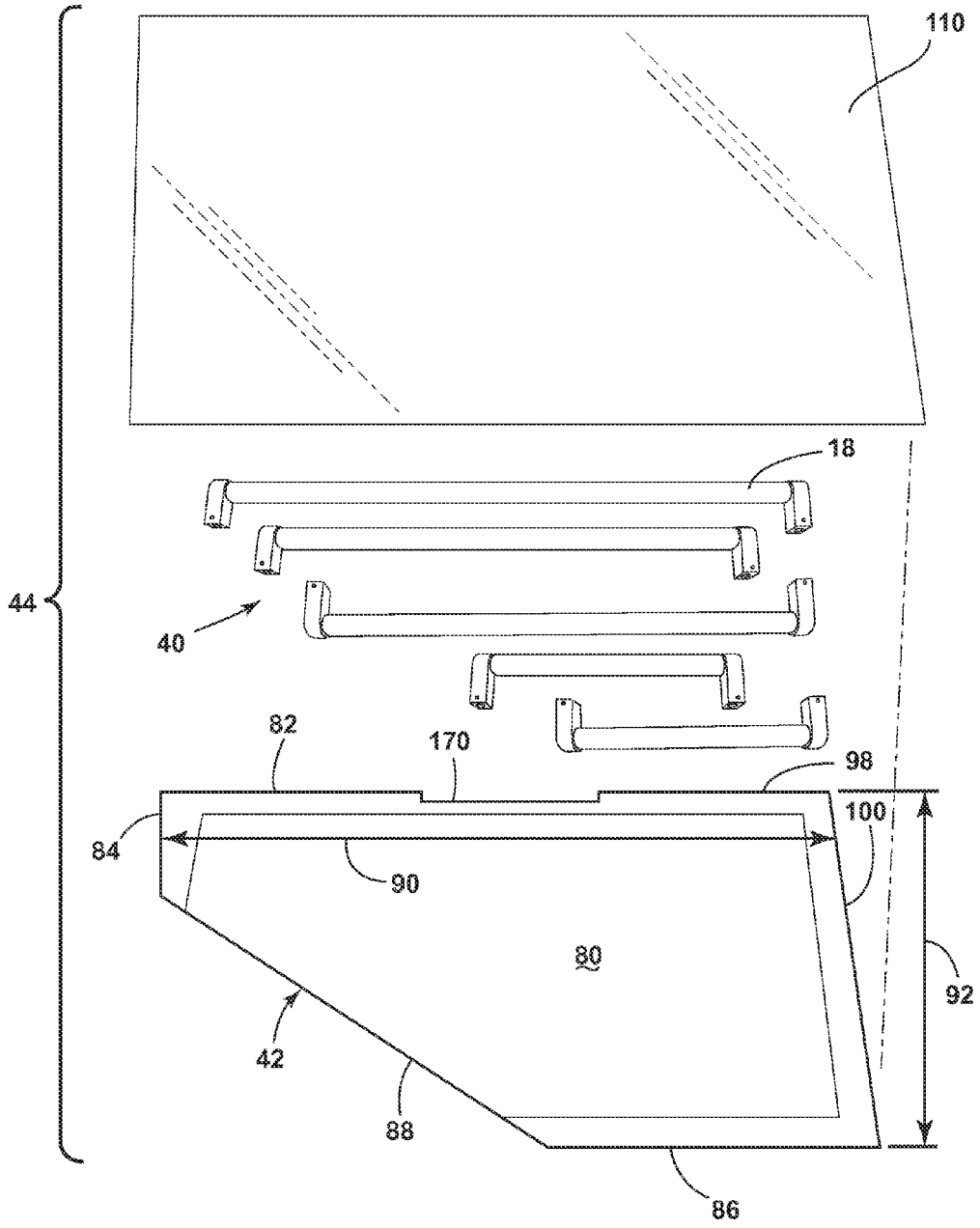
FIG. 4 is a top exploded perspective view of the handle set package of FIG. 3.
Figure 5:
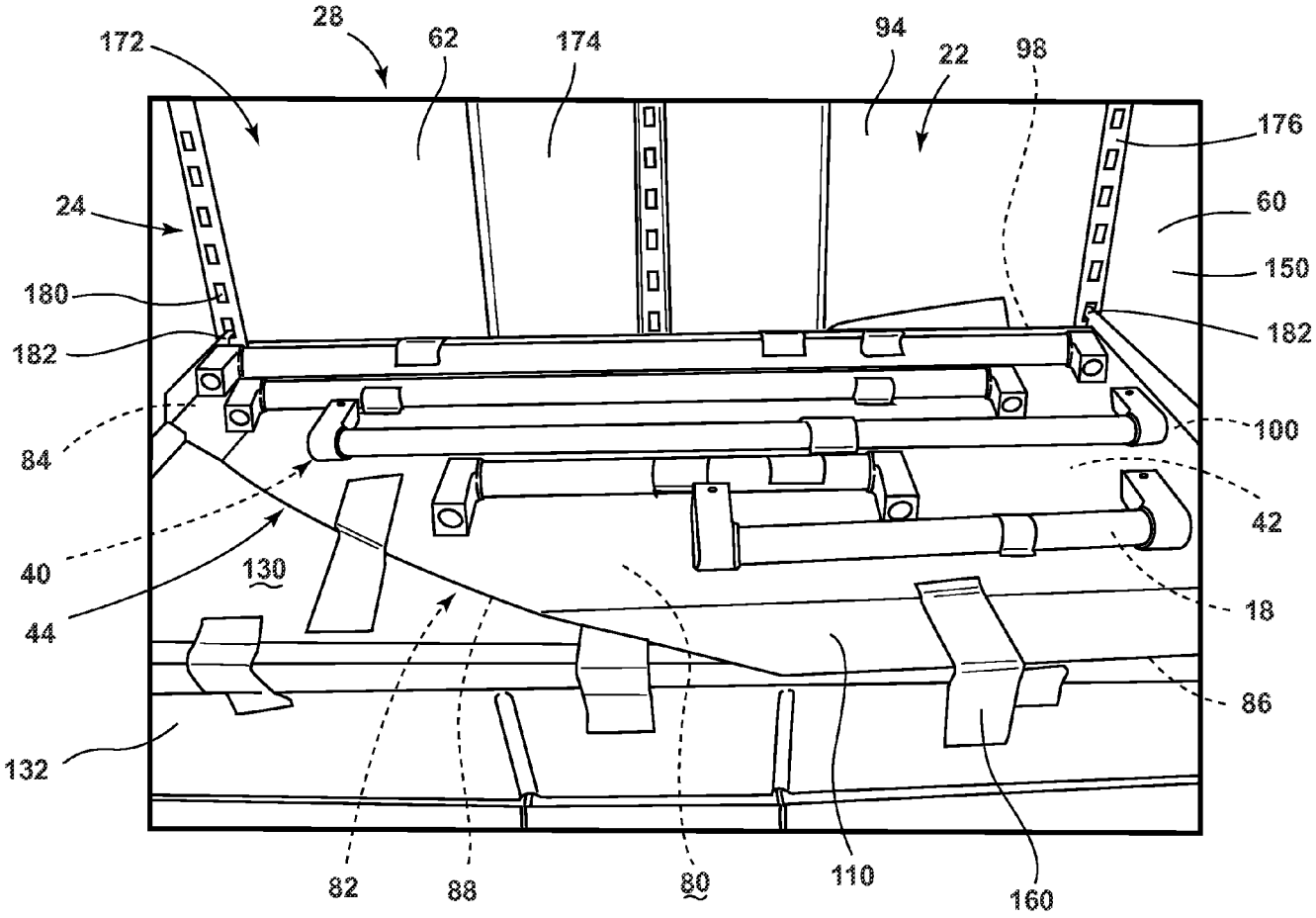
FIG. 5 is a front perspective view of the handle set package disposed within the interior of the appliance and with the doors in an open position.
Figure 6:
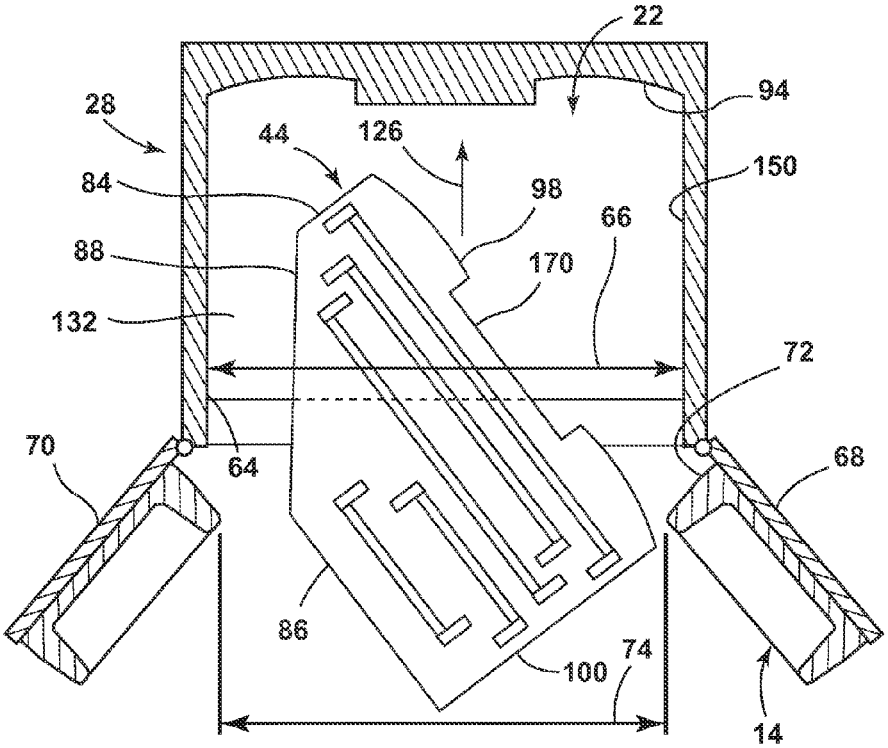
FIG. 6 is a schematic cross-sectional view of the refrigerator of FIG. 2 taken along line VI-VI with the handle set package partially installed within the interior of the appliance.
Figure 7:
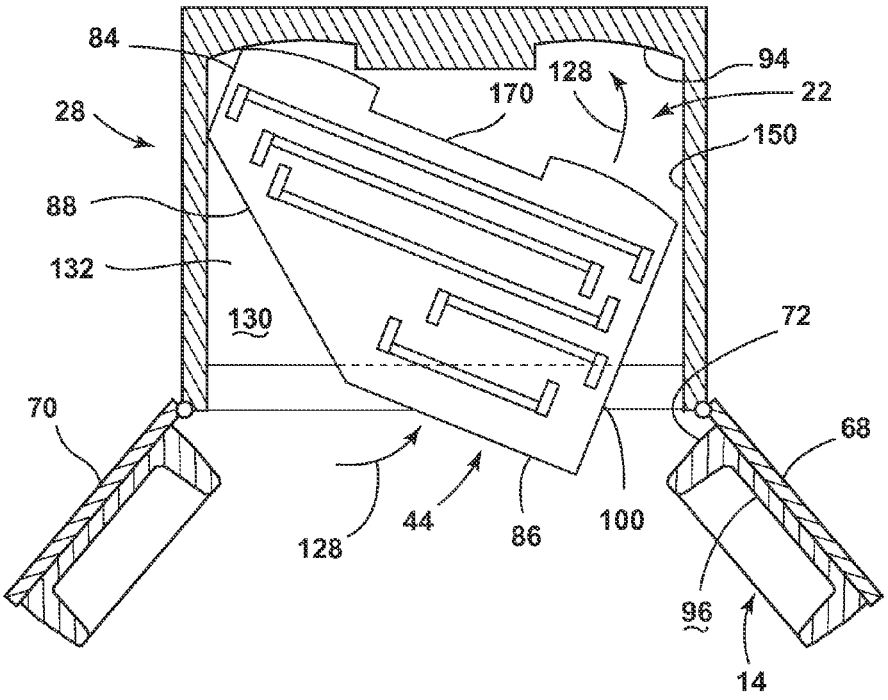
FIG. 7 is a schematic cross-sectional view of the appliance of FIG. 6 showing the handle set package being rotated through the opening and aperture of the appliance.

According to the various embodiments, as exemplified in FIGS. 3-5, the handle set 40 can be attached to the upper surface 80 of the substrate panel 42 by placing the handle set 40 onto the upper surface 80 and securing the handle set 40 to the upper surface 80 through the use of a film member 110, such as shrink wrap or other securing film, tape, straps, adhesives, or other similar attachment mechanism.

Figure 9:
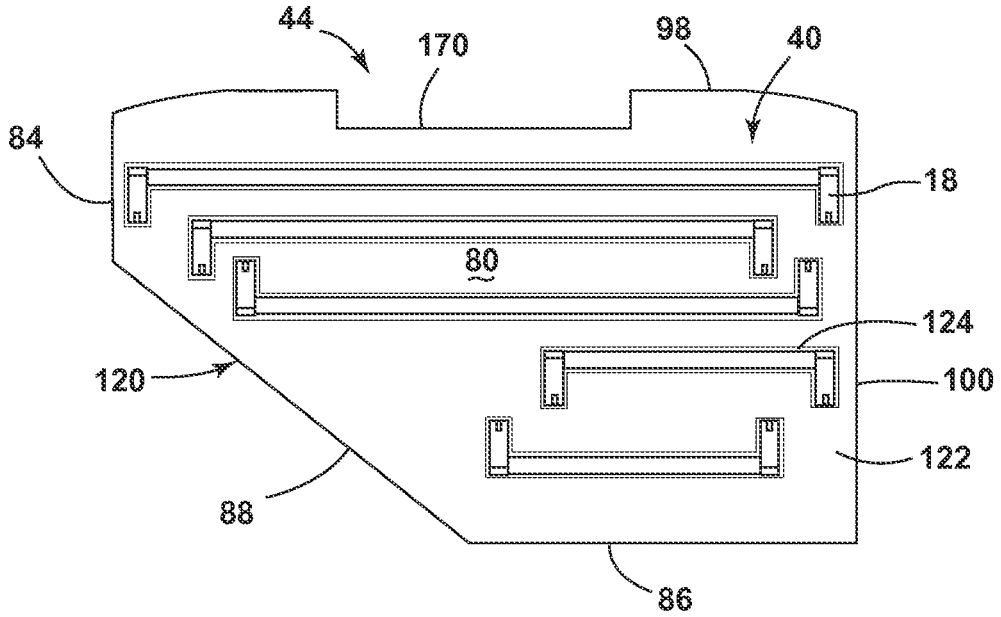
FIG. 9 is a top plan view of another alternate embodiment of the handle set package.
Figure 10:
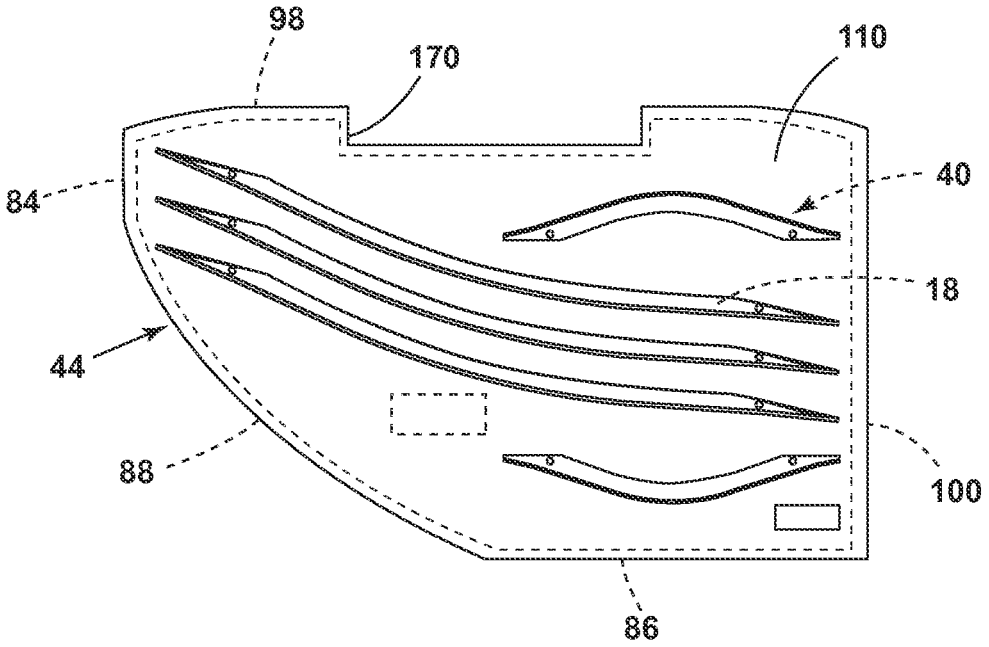
FIG. 10 is a top plan view of another alternate aspect of the handle set package.
Figure 11:
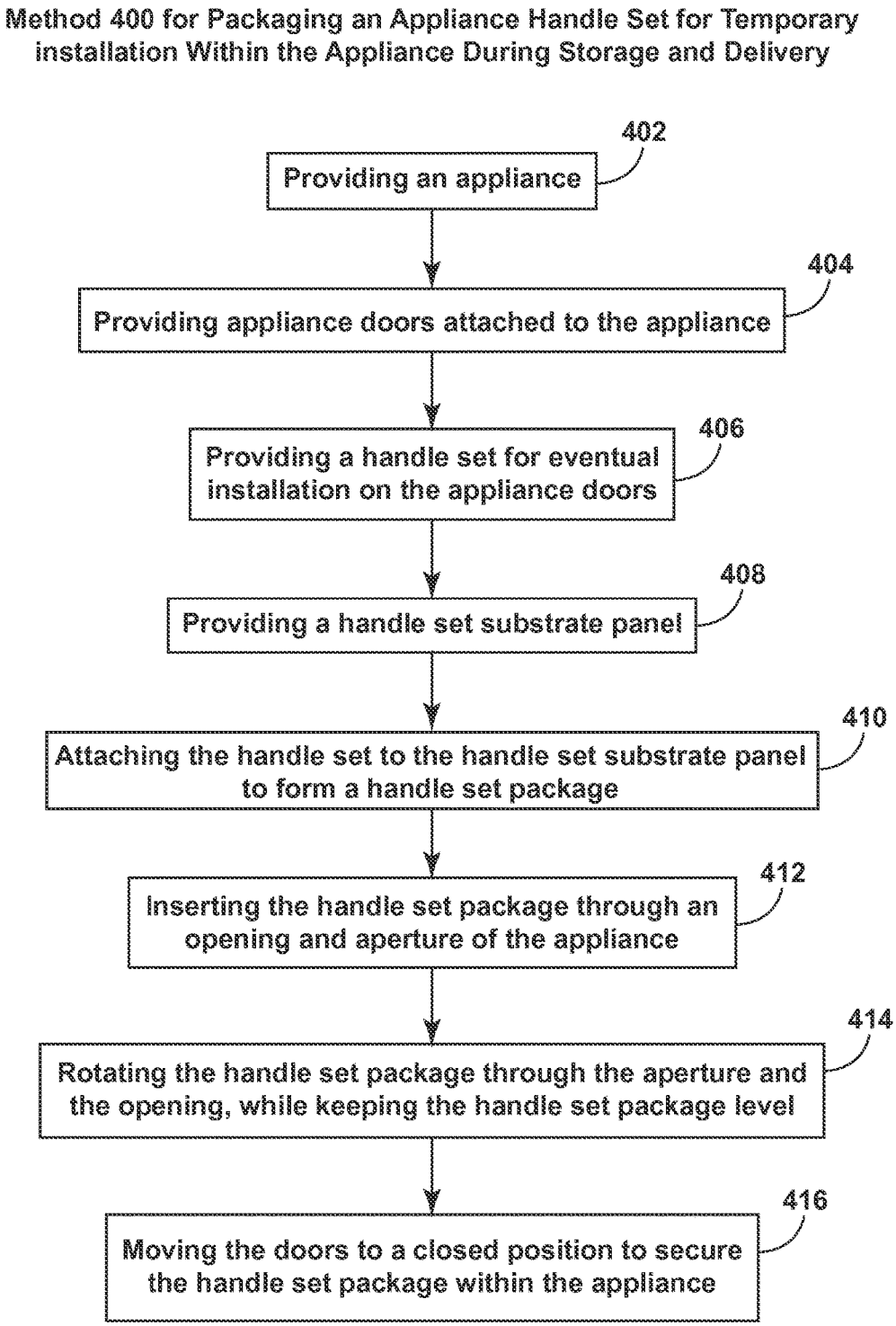
FIG. 11 is a linear flow diagram illustrating a method for packaging a handle set for an appliance for secure delivery within an interior of the appliance onto which the handle set is to be installed.

Referring now to FIG. 9, in various embodiments, it is also contemplated that the handle set substrate panel 42 can include a substantially planar member having a plurality of layers 122 installed therein, such as a multi-layer corrugated cardboard panel 120. In such an embodiment, one of the layers 122 of the corrugated cardboard can be cut out in substantially the same shape as each of the handles 18 of the handle set 40. In this manner, by cutting out a layer of the corrugated cardboard, recesses 124 can be defined within the cardboard within which the handles 18 can be set and substantially secured. It is also contemplated that in this embodiment, a wrapping film, tape, adhesive, or other mechanism, similar to that described above, can be implemented in addition to using the cutouts defined within the corrugated cardboard member.

Referring again to FIGS. 3-8, once the handle set package 44 is formed by substantially securing the handle set 40 to the handle set substrate panel 42, the handle set package 44 can be inserted into the interior volume 22 of the appliance 10. In doing so, it is contemplated that the leading edge 84 can be inserted first, in a lateral movement 126, through the aperture 72 in the opening 64. In this manner, the narrower dimension of the substrate panel 42 defined between the installation cutout 88 and the back edge 98 and/or the side edge 100, of the substrate panel 42 is afforded ample clearance to allow the handle set package 44 to be inserted through the opening 64 and the aperture 72 without having to tilt, bend, fold, or otherwise manipulate the handle set package 44. Accordingly, due to the installation cutout 88, the handle set package 44 can be inserted, leading edge 84 first, through the opening 64 in the aperture 72 such that the handle set package 44 is positioned in a substantially horizontal configuration and parallel with the top surface 130 of the crisper compartment 132 defined within the refrigerating appliance 28.

Referring again to FIGS. 6-8, once the leading edge 84 of the handle set package 44 is installed into the interior volume 22, the handle set package 44 can be moved in a rotational movement 128 through the aperture 72 in the opening 64 such that the trailing edge 86 of the substrate panel 42 is allowed to move through the opening 64 and into the interior volume 22 of the appliance 10. As stated previously, the configuration of the installation cutout 88 provides the handle set package 44 with sufficient clearance to be rotated through the opening 64 and the aperture 72 such that the perimeter edge 82 of the handle set substrate panel 42 and the handle set package 44 as a whole, remains substantially level with respect to the width 74 of the aperture 72 and the opening width 66 as the handle set package 44 is rotated into the interior volume 22. In this manner, as the handle set package 44 is rotated into the interior volume 22, the configuration of the installation cutout 88 allows the handle set package 44 to be rotated in a configuration that is substantially parallel with the top surface 130 of the crisper compartment 132.

The ability to install and rotate the handle set package 44 through the opening 64 in the aperture 72 and into the interior volume 22 of the appliance 10 while maintaining a substantially level positioning that is substantially parallel with the top surface 130 of the crisper compartment 132 minimizes the amount of space necessary to provide for the installation of the handle set package 44 of the appliance 10. Accordingly, other aspects of the appliance 10 that may be transported within the interior volume 22 of the appliance 10 can be located therein before placement of the handle set package 44 within the interior volume 22. Accordingly, various shelves, bins, racks, storage compartments, and other accessory items related to the operation of the appliance 10 can be secure within the interior volume 22 of the appliance 10 before the handle set package 44 is positioned therein. As such, the only space that is substantially needed for placement of the handle set package 44 within the interior volume 22 is a space that is substantially the same height as the handle set package 44 itself. The remainder of the space of the interior volume 22 can be used for the placement of other packaging assemblies prior to delivery of the appliance 10. Based upon this configuration, the handle set package 44 can be placed within the interior volume 22 of the appliance 10 at substantially any point during the packaging process for the appliance 10. Additionally, the minimal space needed for installation of the handle set package 44 within the interior volume 22 of the appliance 10 allows for the handle set package 44 to be installed upon any substantially horizontal partition 140 within the interior volume 22 of the appliance 10. Such horizontal partitions 140 can include, but are not limited to, shelves, a liner base, a substantially horizontal surface within a freezer or pantry compartment, a false mullion, or other similar substantially horizontal partition 140 within the interior volume 22 of the appliance 10.

Figure 8:
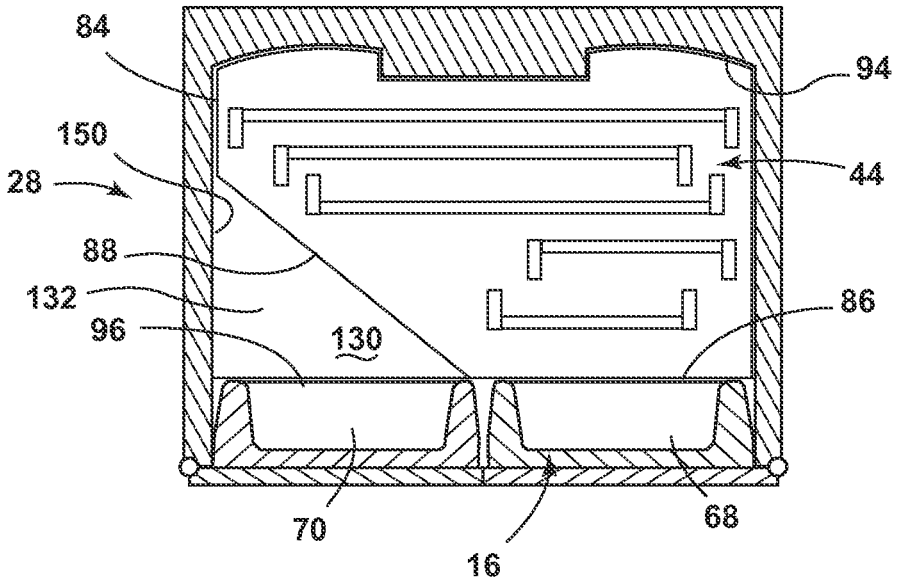
FIG. 8 is a schematic cross-sectional view of the appliance of FIG. 7 showing the handle set package installed within the interior of the appliance and the doors moved to the closed position.

Referring now to FIG. 8, once the handle set package 44 is placed within the interior volume 22 of the appliance 10, the first and second refrigerator doors 68, 70 can be moved to the closed position 16 after the handle set package 44 is inserted and rotated into the interior volume 22. When the first and second refrigerator doors 68, 70 are moved to the closed position 16, the handle set package 44 is secured in a substantially fixed position within the interior volume 22. In this manner, the trailing edge 86 of the handle set substrate panel 42 is configured to substantially engage an interior surface 96 of at least one of the first and second refrigerator doors 68, 70 when the handle set package 44 is rotated into the interior volume 22 and the first and second refrigerator doors 68, 70 are moved to the closed position 16. In this manner, the back edge 98 of the handle set substrate panel 42 substantially engages the back wall 94 of the interior liner 62 such that the handle set substrate panel 42 is substantially secured between the interior surface 96 of one of the first and second refrigerator doors 68, 70 in the back wall 94 of the liner. Moreover, the handle set package 44 is also laterally secured within the interior volume 22 between the liner sidewalls 150 through the engagement of the leading edge 84 of the handle set substrate panel 42 with one of the liner sidewalls 150 and a side edge 100 of the handle set substrate panel 42 with the opposing liner sidewall 150.

Referring again to FIGS. 4 and 5, in addition to the engagement between the handle set substrate panel 42 and the inner surfaces of the liner sidewall 150 and the first and second refrigerator door 68, 70, the handle set package 44 can also be secured within the interior volume 22 by taping the handle set package 44 to at least one other crisper compartment 132 or other horizontal partition 140 in the interior liner 62. Adhesive tape 160, adhesives, films, and other securing members can also be used to substantially secure the handle set package 44 within the interior volume 22 of the appliance 10. It is also contemplated that various spacing blocks can used to at least partially secure the handle set package 44 within the interior volume 22. In such an embodiment, the spacing blocks are typically used to space apart the various shelves of the appliance 10 that are disposed within the interior volume 22. These spacing blocks can also be used to at least partially secure the handle set package 44 and limit vertical and horizontal movement of the handle set package 44. It is contemplated that the spacing blocks can be made of various materials that include cardboard, foam, expanded polystyrene (EPS), combinations thereof, and other similar materials that can be positioned as spacers between the shelves.

Referring now to FIGS. 2-8, when the handle set package 44 is installed within the interior volume 22 of the appliance 10, the back edge 98 of the perimeter edge 82 of the substrate panel 42 is configured to engage the back wall 94 of the interior liner 62. According to various embodiments, it is contemplated that the back edge 98 of the substrate panel 42 can include one or more locating notches 170 that cooperate with a contoured portion 172, such as an inwardly projecting panel or other member within the interior volume 22. In this manner, the engagement between the locating notch 170 of the substrate panel 42 and the contoured portion 172 of the liner sidewall 150 is configured to at least partially secure the handle set package 44 within the interior volume 22. According to the various embodiments, it is contemplated that the contoured portion 172 can be a panel, bracket, protuberance, or other member that extends at least partially into the interior volume 22. Examples of such contoured portions 172 can include, but are not limited to, the cooling tower 174, shelving brackets 176, various liner contours, and other similar geometries. It is also contemplated that the locating notch 170 of the back edge 98 of the substrate panel 42 can extend outward from the substrate panel 42 to engage an outward portion defined within the interior liner 62 of the appliance 10. By way of example, and not limitation, it is contemplated that the cabinet 60 can include a shelf retaining system, such as a ladder shelving bracket, defining a plurality of bracket recesses 180 that are configured to substantially secure shelves and other aspects of the appliance 10 in a vertical position within the interior volume 22 of the refrigerating appliance 28. In such an embodiment, it is contemplated that the handle set substrate panel 42 can include at least one tab 182 that is configured to extend into at least one of the plurality of bracket recesses 180 of the shelving brackets 176 to at least partially secure the handle set package 44 within the interior volume 22. Accordingly, when the handle set package 44 is rotated into the interior volume 22 of the appliance 10, the tab 182 of the substrate panel 42 is configured to be positioned within one of the bracket recesses 180 of the shelving brackets 176 to position and substantially secure the handle set package 44 within the interior volume 22 of the appliance 10.

Referring now to FIGS. 1-11, having described the formation of the handle set package 44 and the installation of the handle set package 44 within the interior volume 22 of the appliance 10 for storage and delivery purposes, a method is disclosed for packaging an appliance handle set 40 for installation within the appliance 10 during storage and delivery. According to the method 400, an appliance 10, such as a refrigerator, is provided having a cabinet 60 that includes the interior liner 62 defining the interior volume 22 of the appliance 10 (step 402). The first and second refrigerator doors 68, 70 of the appliance 10 are also provided, where the doors 12 are attached to the cabinet 60 and are operable between open and closed positions 14, 16 (step 404). According to the various embodiments, it is contemplated that the handle set package 44 can be used for appliances 10 other than refrigerating appliances 28. Such appliances 10 can include, but are not limited to, ovens, freezers, grills, cabinetry, furniture, and other fixtures and appliances where portions thereof can be transported within an interior volume 22 defined within the particular fixture or appliance 10.

Referring again to FIGS. 1-11, a handle set 40 is also provided that is configured to be installed onto the various doors 12 of the appliance 10 (step 406). According to the various embodiments, the various handles for the appliance 10 can include door handles, drawer handles, knobs, levers, dials, and other grasping-type members. It is contemplated that any outwardly extending grasping member, user interface, control feature, or other portion of the appliance 10 that can be removed can be placed upon the handle set substrate panel 42 and secured thereto, for placement within the interior volume 22 of the appliance 10 for delivery and storage purposes. In addition to providing additional clearance for packaging purposes, the handle set substrate panel 42 and the handles 18 disposed thereon to form the handle set package 44 can be implemented to prevent scratching, denting, discoloration, or other damage to the handle set 40 during delivery and storage of the particular appliance 10. It is also contemplated that the handle set package 44 can be used to secure other parts and fixtures of the appliance 10 within the interior volume 22. Such parts and fixtures can include, but are not limited to, trim pieces, water filters, leveler components, bins, ice maker parts, trays, electrical components, and other similar components of the appliance that may be at least partially removable.

Referring again to FIGS. 2-11, the handle set substrate panel 42 is provided, where the handle set substrate panel 42 includes the installation cutout 88 for providing clearance for the handle set package 44 to be installed and rotated within the interior volume 22 of the appliance 10 (step 408). As discussed above, at least a portion of the perimeter edge 82 of the substrate panel 42 takes the form of at least a portion of a horizontal plane defined by the interior volume 22 of the appliance 10. Accordingly, when the handle set package 44 is installed within the interior volume 22, portions of the perimeter edge 82 engage the interior liner 62 as well as the interior surface 96 of one or more of the doors 12 of the appliance 10. Once the substrate panel 42 is provided, the handle set 40 is attached to the upper surface 80 of the handle set substrate panel 42 to define the handle set package 44 (step 410). According to the various embodiments, the handle set substrate panel 42 can be made of any one of various materials that include, but are not limited to, cardboard, plastic, metal, polymer, rubber, or other similar material that can be used to install the handle set 40 within the interior volume 22 of the appliance 10 without causing damage to the interior surfaces 96 of the particular appliance 10. By way of example, and not limitation, the use of cardboard is shown in FIGS. 4 and 5.

Referring again to FIGS. 6-8 and 11, once the handle set package 44 is formed, the handle set package 44 is inserted into the interior volume 22 by inserting the leading edge 84 of the substrate panel 42 through the aperture 72 and the opening 64 of the appliance 10 (step 412). The handle set package 44 is then rotated through the aperture 72 in the opening 64 such that the trailing edge 86 moves and rotates through the opening 64 and into the interior volume 22 (step 414). As discussed previously, the installation cutout 88 in the form of a bevel, chamfer, or other non-orthogonal portion provides clearance for the handle set package 44 to be installed through the narrower aperture 72 of the appliance 10 without having to tilt, bend, fold, or otherwise vertically manipulate the handle set package 44 during installation into the interior volume 22 of the appliance 10. Once installed therein, the first and second refrigerator doors 68, 70 can be moved to the closed position 16 after the handle set package 44 is rotated into the interior volume 22 such that the handle set package 44 is secured in a substantially fixed position within the interior volume 22 when the first and second refrigerator doors 68, 70 are in the closed position 16 (step 416).

According to the various embodiments and as discussed above with respect to FIGS. 2-10, additional securing features can be implemented between the interior volume 22 of the appliance 10 and the handle set package 44 to further secure the handle set package 44 in a predetermined position within the interior volume 22 of the appliance 10. Any one or combination of the above-described securing features can be implemented, depending upon the particular design of the appliance 10 and the handle set package 44 to be installed therein.

The invention claimed is:

1. A method for securing a handle set for transport within a corresponding refrigerator, the method comprising steps of:

providing a handle set configured for later installation onto at least one door of an appliance;

providing a handle set substrate panel having an upper surface, a panel width and a beveled cutout, wherein the handle set substrate panel includes a panel width that is wider than a width of an aperture through which an interior volume of the appliance is accessible when the at least one door is in an open position;

attaching the handle set to the upper surface of the handle set substrate panel to define a handle set package;

rotating the handle set package through the aperture while maintaining the handle set package in a substantially horizontal position such that the beveled cutout provides clearance for the panel width to pass through the aperture; and moving the at least one door to a closed position, wherein the at least one door includes an interior surface that engages the handle set package and secures the handle set package within the interior volume when the at least one door is closed.

2. The method of claim 1, wherein the interior volume includes a horizontal partition having a top surface, wherein the handle set package is rotated into the interior volume and is positioned on the top surface of the horizontal partition, and wherein the step of rotating the handle set package is capable of being accomplished while the upper surface of the handle set substrate panel is substantially parallel with the top surface of the horizontal partition.

3. The method of claim 2, further comprising the step of:

securing the handle set package to the top surface of the horizontal partition by connecting the handle set package to at least one of the horizontal partitions.

4. The method of claim 1, wherein the beveled cutout defines a linear installation cutout.

5. The method of claim 1, wherein the handle set substrate panel includes a locating notch, and wherein when the handle set package is rotated into the interior volume, the locating notch engages an outward portion of an inner liner of the refrigerator to at least partially secure the handle set package within the interior volume.

6. The method of claim 1, wherein the handle set is attached to the upper surface of the handle set substrate panel by extending at least one film member over the handle set and at least a portion of the handle set substrate panel, the film member substantially securing the handle set to the upper surface of the handle set substrate panel.

7. The method of claim 1, wherein the appliance includes a shelf retaining system defining a plurality of bracket recesses, and wherein the handle set substrate panel includes at least one tab that is configured to extend into at least one of the plurality of bracket recesses of the shelf retaining system to at least partially secure the handle set package within the interior volume.

* * * * *